United States Patent [19]

Kauss et al.

[11] Patent Number: 4,574,687

[45] Date of Patent: Mar. 11, 1986

[54] APPARATUS FOR POSITIONING AN ADJUSTING MEMBER

[75] Inventors: Wolfgang Kauss, Lohr-Wombach; Heinz Schulte, Marktheidenfeld; Kurt Wittich, Lohr/Main, all of Fed. Rep. of Germany

[73] Assignee: Mannesmann Rexroth GmbH, Fed. Rep. of Germany

[21] Appl. No.: 717,541

[22] Filed: Mar. 29, 1985

Related U.S. Application Data

[63] Continuation of Ser. No. 515,065, Jul. 19, 1983, abandoned.

[30] Foreign Application Priority Data

Jul. 20, 1982 [DE] Fed. Rep. of Germany ..... 3227060

[51] Int. Cl.[4] ..... F15B 13/042

[52] U.S. Cl. ..... 91/461; 91/388; 91/403; 91/410; 91/469

[58] Field of Search ..... 91/304, 388, 403, 410, 91/461, 469, 446

[56] References Cited

U.S. PATENT DOCUMENTS

| | | | |
|---|---|---|---|
| Re. 26,523 | 2/1969 | Tennis | 91/461 |
| 3,213,886 | 10/1965 | Pearne | 91/461 |
| 3,583,422 | 6/1971 | Dach | 91/433 |
| 3,771,802 | 11/1973 | Hiramatu | 91/31 |
| 3,805,674 | 4/1974 | Sebesta | 91/461 |
| 3,847,060 | 11/1974 | Jasinski et al. | 91/461 |
| 3,872,773 | 3/1975 | Denker | 91/461 |
| 4,148,248 | 4/1979 | Risk | 91/461 |
| 4,350,209 | 9/1982 | O'Conner | 91/387 |
| 4,404,897 | 9/1983 | Leonard | 91/461 |
| 4,421,012 | 12/1983 | Mucheyer | 251/209 |
| 4,463,660 | 8/1984 | Mucheyer et al. | 91/469 |
| 4,510,847 | 4/1985 | Mucheyer et al. | 91/461 |

FOREIGN PATENT DOCUMENTS 2940403 4/1981 Fed. Rep. of Germany ..... 91/461

*Primary Examiner*—Charles T. Jordan
*Assistant Examiner*—Richard Klein
*Attorney, Agent, or Firm*—Roylance, Abrams, Berdo & Goodman

[57] ABSTRACT

An apparatus for positioning an adjustable member as a function of a command signal and a control condition, especially for the positioning of a hoisting mechanism on a tractor or the like, comprises an operating circuit and a control circuit. The operating circuit has a bidirectional positionable valve with a valve side and first and second control devices for regulating flow of pressure medium from a supply tank to the adjustable member. The control circuit connects a control pressure medium source to the control devices at first and second junctions and includes adjustable throttles and a flow-regulating valve. A first adjustable throttle is connected between the supply tank and the first junction. The second adjustable throttle is connected between the control pressure medium source and the first junction and in series with the first adjustable throttle. Third and fourth throttles are connection in series with the third throttle being connected between the supply tank and the second junction, and with the fourth adjustable throttle being connected between the control pressure medium source and the second junction. The flow regulating device is connected between the control pressure medium source and the first junction in parallel with the second adjustable throttle such that the flow regulating valve can be located in a remote location from the remaining controls, permitting remote operation of the adjustable member.

9 Claims, 3 Drawing Figures

APPARATUS FOR POSITIONING AN ADJUSTING MEMBER

This is a continuation of application Ser. No. 515,065 filed July 19, 1983 now abandoned.

This invention relates fo an apparatus for controlling the position of an adjustable or movable member, and particularly for controlling a hoisting unit associated with a tractor, combine or the like. This invention is an improvement on the subject matter of U.S. patent application Ser. No. 188,453, entitled Apparatus For Controlling An Adjustable Member and filed Sept. 18, 1980, and the subject matter of U.S. patent application Ser. No. 347,071, entitled Apparatus For Adjusting The Position of an Adjustable Element filed Feb. 8, 1982, the content of which applications are hereby incorporated by reference.

BACKGROUND OF THE INVENTION

Prior apparatus for controlling the position of a adjustable member do not have an arrangement for operating the adjustable member at a location different and remote from the remaining controls of the apparatus. Conventionally, all of the controls are located at the driver's seat. However, the operator may need to operate the adjustable member as the operator stands adjacent the adjustable member and away from the driver's seat.

Thus, an arrangement is needed by which the adjustable member can be operated from a remote location.

BRIEF DESCRIPTION OF THE INVENTION

An object of the present invention is to provide an apparatus for positioning an adjustable member which can be operated from more than one location.

Other objects, advantages and salient features of the present invention will become apparent from the following detailed description of a preferred embodiment of the invention.

Briefly described, the invention includes an apparatus for positioning an adjustable member as a function of a command signal and a control condition, especially for the positioning of a hoisting means on a tractor or the like. The apparatus comprises an operating circuit and a control circuit. The operating circuit has a bidirectional positionable valve with a valve slide and with first and second control devices for regulating flow of pressure medium from a supply tank to the adjustable member. The control circuit connects a control pressure medium source to the control devices at first and second junctions, and includes adjustable throttles and a flow regulating valve. First and second adjustable throttles are connected in series between the control pressure medium source and the supply tank, with the first adjustable throttle connected between the supply tank and the first junction and the second adjustable throttle connected between the control pressure medium source and the first junction. Third and fourth adjustable throttles are connected in series, with the third adjustable throttle being connected between the supply tank and the second junction and with the fourth adjustable throttle being connected between the control pressure medium source and the second junction. The flow regulating valve is connected between the control pressure medium source and the first junction in parallel to the second adjustable throttle.

By arranging the control apparatus in this manner, the flow regulating valve can be located remote from the controls for the adjustable throttles. The flow regulating valve can be located in the area of the lifting mechanism, permitting adjustment of the lifting mechanism in a simple manner, e.g., for facilitating the attachment of an operating device to a tractor. With the flow regulating valve so located, the driver of the tractor, combine, etc. need not only operate the adjustable member from the driver's seat, but may operate it while standing adjacent the adjustable member, permitting the operator to more clearly see and control the movement.

Since the flow regulating valve is attached at a different location from the remainder of the apparatus for regulating the position of the adjustable member, the flow regulating valve can have a different temperature from the remainder of the apparatus through which the fluid pressure medium flows constantly. Thus, preferred arrangements of the invention include mechanisms for maintaining the flow regulating valve at a temperature substantially equal to that of the remaining apparatus through which fluid pressure medium flows constantly. The flow regulating valve can have a stop preventing closing of its through-flow cross-section to permit a constant flow of pressure medium from the control pressure medium source through it.

Alternatively, or additionally, the flow regulating valve can include a housing having a flow-through channel in fluid communication with and between the control pressure medium source and the second adjustable throttle. By this arrangement, the fluid pressure medium conveyed from the control pressure medium source flows through the flow regulating valve adapting the valve to the temperature of the remaining apparatus through which the pressure medium flows.

BRIEF DESCRIPTION OF THE DRAWINGS

In order that the manner in which the foregoing and other objects are obtained in accordance with the invention can be understood in detail, a particularly advantgeous embodiment thereof will be described with reference to the accompanying drawings, which form a part of this application, and wherein.

DETAILED DESCRIPTION OF THE PREFERRED EMBODIMENT OF THE INVENTION

Figure 1:
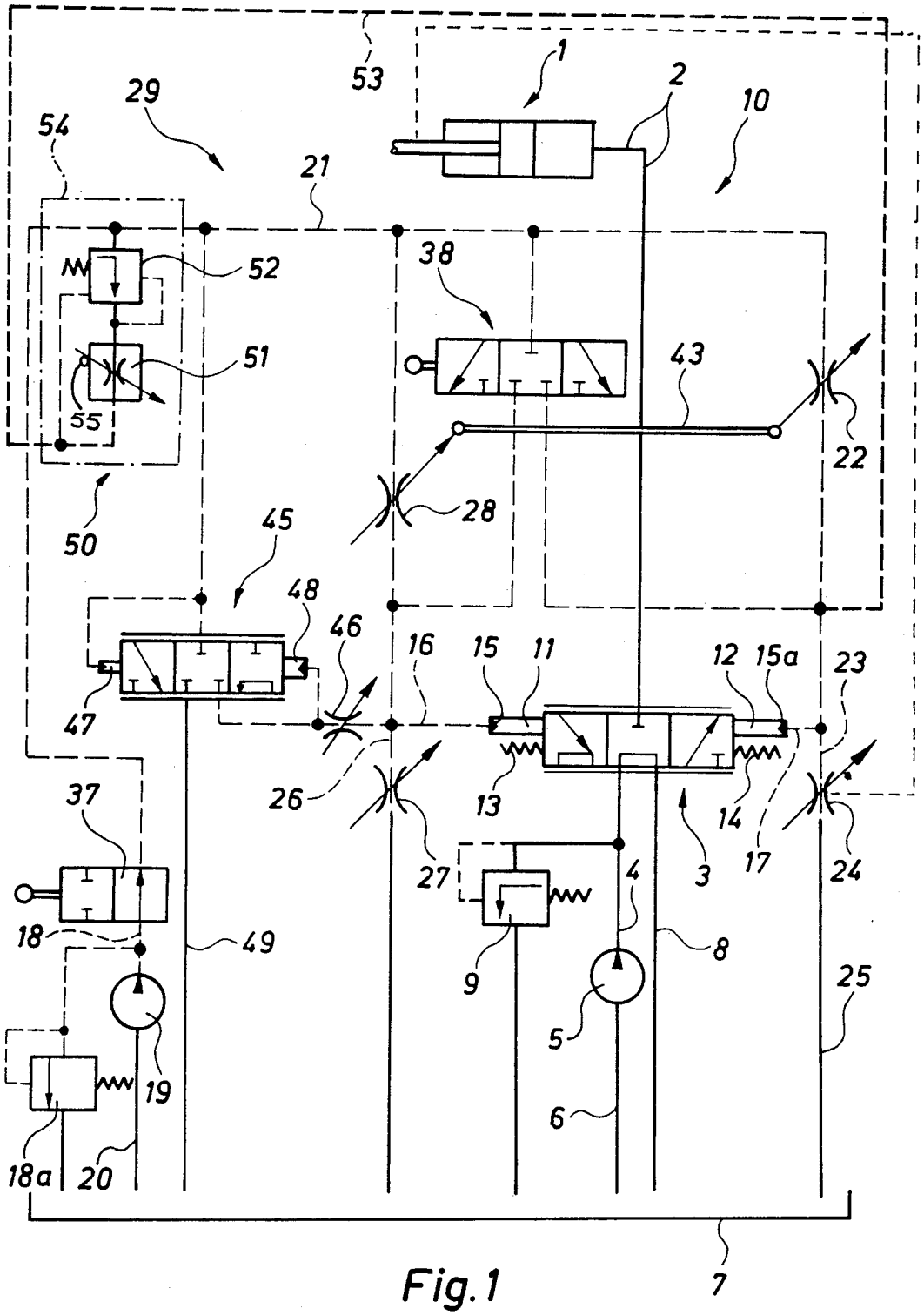
FIG. 1 is a schematic fluid and control circuit diagram of an apparatus in accordance with the invention.

Referring to FIG. 1, an adjustable member or element 1 is illustrated in the form of a single-acting piston and cylinder arrangement. The cylinder is connected by a fluid line 2 with a multi-way or bidirectional positionable valve 3 operable in opposite directions by control pressure. The pressure side of a pump 5 is connected to valve 3 by a fluid line 4 with the intake line 6 of the pump extending into supply tank 7. Valve 3 is connected to supply tank 7 through fluid line 8. The components of the system identified with numbers 1 through 9 form an operating loop or circuit which is generally indicated at 10.

Valve 3 has control devices 11 and 12 disposed at its opposite sides for controlling operation of its movable slide. These devices, under the influence of a pressure medium (liquid or gas) tend to move the slide in opposition to the biasing force of one of the control springs 13 or 14 in the direction of arrows 15 or 15*a* which are illustrated in the control devices to which they relate. The two control springs 13,14 tend to hold the slide in its middle position, as illustrated, when control devices 11 or 12 are not actuated.

A control line 16 is connected to control device 11, while a control line 17 is connected to control device 12. A control line 18 is connected to the pressure side of a control pump 19 having an intake line 20 connected with supply tank 7. A pressure limiting valve 18*a* is connected with control line 18.

A control line 21 is connected to control line 18 through a two-position valve 37 and extends from valve 37 to an adjustable throttle 22. A control line 23 connects adjustable throttle 22 to an adjustable throttle 24 which is connected through a line 25 with supply tank 7. Control line 23 is connected to control line 17 at a junction located between adjustable throttles 22,24.

Two adjustable throttles 27 and 28 are connected with control line 16 through a control line 26 at a junction between throttles 27 and 28. The opposite side of adjustable throttle 27 is connected to supply tank 7, while the other side of adjustable throttle 28 is connected to control line 21 between valve 37 and adjustable throttle 22. The described control elements are identified as a control circuit indicated generally at 29.

Adjustable throttles 22 and 28 have mechanically movable adjustment elements which are interconnected with each other by a mechanical linkage 43 such that they are counter-rotating, i.e., rotate in opposite directions. These throttles ae configured as a supplier of a reference setting. Adjustable throttles 24 and 27 are configured such that control parameters are applied to them, making them an actual value transmitter. Throttle 24 is connected mechanically with the movable part of adjustment member 1 and throttle 27 with another means, especially with means for measuirng the tractive power of the tractor. In order to stabilize the control slide of valve 3 in its movment, control device 11 preferably has the same effective cross section as control device 12.

The connection between control pump 19 and the remainder of control circuit 29 is controlled by switch or relay valve 37 inserted between control lines 18 and 21. Thus, actuation of the control circuit is controlled by actuation of valve 37.

A second switch or relay valve 38 is connected to lines 16, 17 and 21 at respective ones of its three connection ports. When the control element of valve 38 is in the position illustrated in FIG. 1, lines 16, 17 and 21 are disconnected from each other at switch valve 38. In both of the other control positions of the control element of valve 38, line 21 is connected directly either with line 16 or line 17. The second switch or relay valve 38 serves as a quick make or break switch for rapid operation or movement of adjustable member 1. By means of valve 38, either one of control devices 11 or 12 can be switched to fluid communication with control pump 19, bypassing adjustable throttle 22 or 28 such that pressure is rapidly directed to the desired control device 11 or 12, thereby permitting rapid adjustment of adjustable member 1. The flow of pressure medium or agent to control circuit 29 is terminated or cut off by closing valve 37 if adjustable member 1 is sufficiently activated, i.e., when the piston is at an end position in its cylinder. When the control element of valve 38 is returned to the position illustrated in the drawing, valve 37 is also returned to the on position illustrated in the drawing.

A proportional pressure regulator or pressure ratio valve 45 is provided in the control circuit. The valve is in the configuration of a three-position, three-port, proportional valve with two control devices 47 and 48. Control device 47 has a smaller pressure surface than that of control device 48. Preferably, the pressure surface of control device 47 is one-half of the pressure surface of control device 48. Control line 21 is connected to control device 47 and is also connected to a connection point of proportional pressure regulator 45. Control device 48 is connected to a second connection point of proportional pressure regulator 45 and to control line 16 through adjustable throttle 46. A third connection of the proportional pressure regulator is connected with supply tank 7 through line 49. When throttle 46 is open, proportional pressure regulator 45 acts on control device 11 of valve 3. Any change in the adjustment of adjustable throttles 27 and 28 is compensated by proportional pressure regulator 45. The greater the influence of adjustable throttle 46, the lower the effect of the proportional pressure regulator 45 is on control device 11.

A flow regulating valve 50 is connected between control pump 19 and line 17 leading to control device 12, and is connected in parallel to adjustable throttle 22. Valve 50 has an adjustable starting flow and comprises an adjustable throttle 51 coupled in series with a pressure compenstor 52. The inlet of pressure compensator 52 is connected to control line 21, while the pressure compensator outlet is coupled to the inlet of adjustable throttle 51. The outlet of adjustable throttle 51 is connected by control line 53 to control line 23 joining adjustable throttles 22 and 24.

Flow regulating valve 50 is contained in a special housing 54 located in the general area of adjustable member 1. Valve 50 permits the adjustment member to be operated at a location remote from adjustable throttles 22, 24, 27, 28 and 46 which are disposed side by side.

To ensure that the pressure medium flowing through flow regulating valve 50 has approximately the same temperature, and thus approximately the same viscosity, as the pressure agent flowing through the remainder of control arrangement 29, either line 21 passes through regulator housing 54 by providing a mechanical stop 55 on the adjustable throttle 51 or the flow of the pressure agent through the regulating valve 50 cannot be completely stopped. Alternatively, both the passage of line 21 through housing 54 and prevention of complete closing of valve 50 can be employed together. Pressure agent can be caused to flow constantly through flow regulating valve 50 by providing a stop 55 preventing movement of the valve's movable member to a position completely closing the flow through the cross-sectional area of the valve. The pressure agent or medium conveyed in line 21 can be conveyed through housing 54 by a flow through channel in the housing connected on its first side to the pressure side of control pump 19 and on its opposite or outlet side with adjustable throttle 22, which adjustable throttle is coupled in parallel to flow regulating valve 50.

Figure 2:
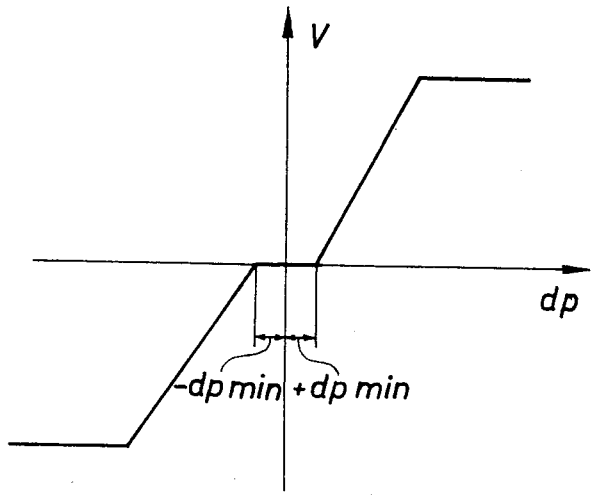
FIG. 2 is a volume-pressure diagram illustrating operational aspects of the apparatus in accordance with the invention.

As illustrated in FIG. 2, the volume pumped by pump 5 and flowing through multi-way valve 3 per unit time is a function of the differential pressure, indicated as dp, applied to and influencing control devices 11 and 12. When the slide of valve 3 is in its middle position, there is a minimum effective differential pressure $dp_{min}$ which must be applied to cause the slide to leave its middle or neutral position causing pressure agent to begin flowing through valve 3.

Figure 3:
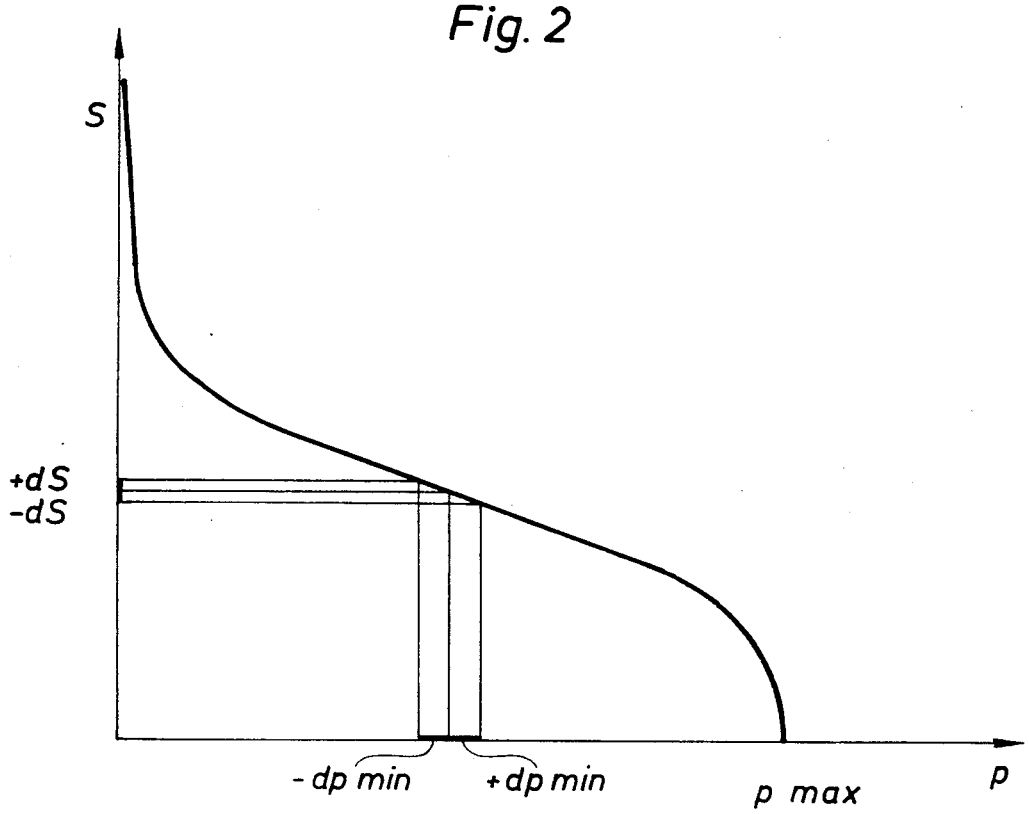
FIG. 3 is a throttle surface-pressure diagram illustrating operational aspects of the apparatus in accordance with the invention.

FIG. 3 illustrates the relationship between the cross-sectional area S of a throttle as a function of the pressure P prevailing in front (upstream) of the throttle at a constant conveying pressure Pmax of control pump 19 and at a constant setting of the throttle preceding the throttle whose characteristics are plotted. The adjustable cross section of adjustable throttles 22 and 24, as well as of adjustable throttles 27 and 28, is selected by determining, from the middle of the essentially linear portion of the curve shown in FIG. 3, the amount of the change of the cross-sectional area ds of the throttle for producing a pressure deviation $dp_{min}$ between control mechanisms 11 and 12 in either a positive or negative sense.

The precision with which the slide of valve 3 must respond to a change in cross-sectional area in any of the adjusting throttles depends on a precision G, expressed in percent. The product of precision G and of a precision factor F by which ds must be multiplied in order to obtain the largest flow-through cross-section of the throttle necessary for control is 100. Thus, if G is 2 percent, the precision factor F is equal to 50. The maximum adjustable cross-sectional area of an adjustable throttle results from the sum of the largest flow-through cross-section (F×ds) for the control and of the minimum flow-through cross-section (Smin) which is characteristic for the respective adjustable throttle. Thus, the maximum cross-sectional area for each adjustable throttle is selected such that each adjustable throttle has a maximum adjustable cross-sectional area determined by $$Sadj=(ds\cdot F)+Smin, \text{ and}$$

$$F=100/G$$

wherein

Sadj = maximum adjustable cross-sectional area, ds = minimum cross-sectional area change sufficient to cause response of the valve slide of valve 3, Smin = minimum flow cross section for each throttle, and G = predetermined sensitivity of valve 3 expressed in percent.

By connection of adjustable throttles 22 and 24 in series, the flow-through volume V, as a practical matter, is proportional to the controlled or regulating value (in the regulated state), wherein the same pressure is set in line 23.

The adjustment level can be also designated as the actual value, while the reference level can be designated as the theoretical value. With the practical configuration of the exemplary embodiment of FIG. 1, adjustable throttles 22 and 24 influence the lifting position of the lifting mechanism of a tractor, while the adjustable throttles 27 and 28 affect its pulling or traction force.

While a certain advantageous embodiment has been chosen to illustrate the invention, it will be understood by one skilled in the art that various changes and modifications can be made therein without departing from the scope of the invention as defined in the appended claims.

What is claimed is:

1. An apparatus for positioning an adjustable member as a function of a command signal and a controlled condition, especially for the positioning of a hoisting means on a tractor, the apparatus comprising:

an operating circuit having a bidirectional positionable valve with a valve slide and with first and second control devices for regulating flow of pressure medium from a supply tank to the adjustable member;

a control circuit connecting a control pressure medium source to said control devices for said positionable valve at first and second junctions, said control circuit having first and second adjustable throttles connected in series between said control pressure medium source and the supply tank, said first adjustable throttle being connected between the supply tank and said first junction, said second adjustable throttle being connected between said control pressure medium source and said first junction;

third and fourth throttles connected in series between said control pressure medium source and the supply tank, said third throttle being connected between the supply tank and said second junction, said fourth throttle being connected between said control pressure medium source and said second junction; and a flow regulating valve connected in series between said control pressure medium source and said first junction, and in parallel relative to said second adjustable throttle, said flow regulating valve including an adjustable throttle and a pressure compensator connected in series to said adjustable throttle of said flow regulating valve;

whereby control pressure medium flows through said second adjustable throttle or said flow regulating valve when flowing from said control pressure medium source and said first junction.

2. An apparatus according to claim 1 wherein said flow regulating valve has a stop preventing closing of a through-flow cross-section and permitting a constant flow of pressure medium from said control pressure medium source.

3. An apparatus according to claim 2 wherein said flow regulating valve comprises a housing having a flow-through channel in fluid communication with and between said control pressure medium source and said second adjustable throttle.

4. An apparatus according to claim 1 wherein said flow regulating valve comprises a housing having a flow-through channel in fluid communication with and between said control pressure medium source and said second adjustable throttle.

5. An apparatus according to claim 1 wherein said third and fourth throttles comprising adjustable pressure ratio valve means for adjustably maintaining pressure at said second junction at a predetermined pressure level independent of flow-through opening cross-sectional areas in said first and second adjustable throttles.

6. An apparatus according to claim 1 wherein said third and fourth throttles are adjustable.

7. An apparatus according to claim 1 wherein said adjustable throttles have the same maximum flow passage cross-sectional area and are adjustable in the same manner, said maximum cross-sectional area being selected such that said adjustable throttles have a maximum adjustable cross-sectional area determined by $$Sadj=(ds\cdot F)+Smin. \text{ and}$$

$$F=100/G$$

wherein

Sadj = maximum adjustable cross-sectional area, ds = minimum cross-sectional area change sufficient to cause response of said valve slide of said bidirectional positionable valve, Smin = minimum flow cross section for each throttle, and G = predetermined sensitivity of said bidirectional positionable valve expressed in percent.

8. An apparatus for positioning an adjustable member as a function of a command signal and a controlled condition, especially for the positioning of a hoisting means on a tractor, the apparatus comprising:

an operating circuit having a bidirectional positionable valve with a valve slide and with first and second control devices for regulating flow of pressure medium from a supply tank to the adjustable member;

a control circuit connecting a control pressure medium source to said control devices for said positionable valve at first and second junctions, said control circuit having first and second adjustable throttles connected in series between said control pressure medium source and the supply tank, said first adjustable throttle being connected between the supply tank and said first junction, said second adjustable throttle being connected between said control pressure medium source and said first junction;

third and fourth throttles connected in series between said control presure medium source and the supply tank, said third throttle being connected between the supply tank and said second junction, said fourth throttle being connected between said control pressure medium source and said second junction; and a flow regulating valve connected in series between said control pressure medium source and said first junction, and in parallel relative to said second adjustable throttle, said flow regulating valve having a stop preventing closing of a through-flow cross-section and permitting a constant flow of pressure medium from said control pressure medium source;

whereby control pressure medium flows through said second adjustable throttle or said flow regulating valve when flowing from said control pressure medium source and said first junction.

9. An apparatus for positioning an adjustable member as a function of a command signal and a controlled condition, especially for the positioning of a hoisting means on a tractor, the apparatus comprising:

an operating circuit having a bidirectional positionable valve with a valve slide and with first and second control devices for regulating flow of pressure medium from a supply tank to the adjustable member;

a control circuit connecting a control pressure medium source to said control devices for said positionable valve at first and second junctions, said control circuit having first and second adjustable throttles connected in series between said control pressure medium source and the supply tank, said first adjustable throttle being connected between the supply tank and said first junction, said second adjustable throttle being connected between said control pressure medium source and said first junction;

third and fourth throttles connected in series between said control pressure medium source and the supply tank, said third throttle being connected between the supply tank and said second junction, said fourth throttle being connected between said control pressure medium source and said second junction, said third and fourth throttles comprising adjustable pressure ratio valve means for adjustably maintaining pressure at said second junction at a predetermined pressure level independent of flow-through opening cross-sectional areas in said first and second adjustable throttles; and a flow regulating valve connected in series between said conrol pressure medium source and said first junction, and in parallel relative to said second adjustable throttle;

whereby control pressure medium flows through said second adjustable throttle or said flow regulating valve when flowing from said control pressure medium source and said first junction.

* * * * *